US012800203B2

(12) United States Patent
Fujii et al.

(10) Patent No.: US 12,800,203 B2
(45) Date of Patent: Nov. 17, 2026

(54) REFRIGERATION CYCLE APPARATUS

(71) Applicant: Mitsubishi Electric Corporation, Tokyo (JP)

(72) Inventors: Noriyuki Fujii, Tokyo (JP); Yoshihiro Takai, Tokyo (JP); Satoru Toyama, Tokyo (JP); Kengo Hiratsuka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 99 days.

(21) Appl. No.: 18/843,311

(22) PCT Filed: Mar. 10, 2022

(86) PCT No.: PCT/JP2022/010570
§ 371 (c)(1),
(2) Date: Sep. 3, 2024

(87) PCT Pub. No.: WO2023/170858
PCT Pub. Date: Sep. 14, 2023

(65) Prior Publication Data

US 2025/0172323 A1 May 29, 2025

(51) Int. Cl.
*F25B 41/40* (2021.01)
*F25B 1/00* (2006.01)

(52) U.S. Cl.
CPC ..... *F25B 41/40* (2021.01); *F25B 1/00* (2013.01)

(58) Field of Classification Search
CPC ..... F04C 29/00; F25B 47/003; F25B 13/00
See application file for complete search history.

(56) References Cited

U.S. PATENT DOCUMENTS 6,018,010 A * 1/2000 Yamazaki ..... C08F 220/04 526/318.4
2011/0136957 A1 6/2011 Kamishima et al.
2022/0146163 A1* 5/2022 Tanaka ..... F04C 28/00

FOREIGN PATENT DOCUMENTS

JP H05-060254 A 3/1993
JP H05-268740 A 10/1993
JP 2002-349347 A 12/2002
(Continued)

OTHER PUBLICATIONS

Kakegawa (JP2008222888A) English Translation (Year: 2008).*
(Continued)

*Primary Examiner* — Elizabeth J Martin
*Assistant Examiner* — Keona Lauren Banks
(74) *Attorney, Agent, or Firm* — XSENSUS LLP

(57) ABSTRACT

A refrigeration cycle apparatus includes a refrigerant circuit that includes a compressor. The refrigerant circuit is enclosed with refrigerant, the refrigerant circuit includes a component in contact with the refrigerant, and a surface of the component in contact with the refrigerant contains a crystalline resin material. When the temperature of the crystalline resin material is raised at a temperature rise rate of 10° C./min using a differential scanning calorimeter, a value obtained by differentiating an amount of heat measured by the differential scanning calorimeter with respect to time does not have an exothermic peak of 20 μW/mg/min or more in a temperature range of a glass transition temperature of the crystalline resin material to a melting point thereof.

6 Claims, 4 Drawing Sheets

(56) References Cited

FOREIGN PATENT DOCUMENTS

| | | | | |
|---|---|---|---|---|
| JP | 2004-052730 | A | | 2/2004 |
| JP | 2004-208446 | A | | 7/2004 |
| JP | 2008222888 | A | * | 9/2008 |
| JP | 2010-060262 | A | | 3/2010 |
| JP | 2017-043772 | A | | 3/2017 |
| JP | 2021-025670 | A | | 2/2021 |
| JP | 6976494 | B1 | | 12/2021 |

OTHER PUBLICATIONS

ASTM D3418-21, Standard Test Method for Transition Temperatures of Enthalpies of Fusion and Crystallization of Polymers by Differential Scanning Calorimetry, Sep. 2021, [retrieved on Feb. 4, 2024]. Retrieved from <https://compass.astm.org/content-access?contentCode=ASTM%7CD3418-21%7Cen-US>. (Year: 2021).*

International Search Report and Written Opinion mailed on Apr. 26, 2022, received for PCT Application PCT/JP2022/010570, filed on Mar. 10, 2022, 11 pages including English Translation.

* cited by examiner

REFRIGERATION CYCLE APPARATUS

CROSS-REFERENCE TO RELATED APPLICATION

The present application is based on PCT filing PCT/JP2022/010570, filed Mar. 10, 2022, the entire contents of which are incorporated herein by reference.

TECHNICAL FIELD

The present disclosure relates to a refrigeration cycle apparatus.

BACKGROUND ART

In order to ensure the reliability of a refrigeration cycle apparatus, not only the refrigerant and the refrigeration machine oil which are essential to the refrigeration cycle apparatus but also components which are used in the refrigeration cycle apparatus are required to be appropriately designed. In particular, those components such as an insulating film, an insulator, and various valves, which are generally made of resin materials that are more susceptible to degradation than metal materials, including the lifetime of the materials, are required to be designed appropriately. The reliability and productivity of the refrigeration cycle apparatus can be ensured by using the components made of materials appropriately designed for the degradation modes that can occur in the refrigeration cycle apparatus.

For example, PTL 1 (Japanese Patent Laying-Open No. 2004-52730) discloses a method of improving the reliability of a sealed electric compressor by using a liquid crystal polymer resin as the material of an insulator which is used as an insulating member in an electric motor so as to improve the properties such as low formation of oligomers and heat resistance of the insulator. PTL 2 (Japanese Patent Application Laying-Open No. 2004-208446) discloses a method of improving productivity while ensuring reliability by using a liquid crystal polymer that has a lower crystallization latent heat and generates a smaller amount of gas when melted.

CITATION LIST

Patent Literature

PTL 1: Japanese Patent Laying-Open No. 2004-52730
PTL 2: Japanese Patent Laying-Open No. 2004-208446

SUMMARY OF INVENTION

Technical Problem

Conventional considerations for the reliability of a refrigeration cycle apparatus have been related to using a component made of a resin material in a refrigeration cycle apparatus. For example, by using a resin material having low formation of oligomers, the generation of a sludge which may block the refrigeration cycle circuit may be suppressed, and by improving the heat resistance and the moist heat resistance of the resin material, the component may be used for a longer period of time.

However, the components are used in locations where the refrigerant may be present in the refrigeration cycle apparatus in a liquid state or a gaseous state. When the liquid refrigerant soaked into a component expands as it becomes gaseous, the resin material is caused to expand. This causes the component to deform, which may reduce the reliability of the refrigeration cycle apparatus.

The present disclosure has been made in view of the above problem, and an object of the present disclosure is to provide a refrigeration cycle apparatus, the reliability of which is improved by using a crystalline resin material that suppresses the occurrence of expansion in a component in contact with a refrigerant.

Solution to Problem

A refrigeration cycle apparatus includes a refrigerant circuit that includes a compressor, wherein the refrigerant circuit is enclosed with refrigerant, the refrigerant circuit includes a component in contact with the refrigerant, and a surface of the component in contact with the refrigerant contains a crystalline resin material, and when a temperature of the crystalline resin material is raised at a temperature rise rate of 10° C./min using a differential scanning calorimeter, a value obtained by differentiating an amount of heat measured by the differential scanning calorimeter with respect to time does not have an exothermic peak of 20 μW/mg/min or more in a temperature range of a glass transition temperature of the crystalline resin material to a melting point thereof.

Advantageous Effects of Invention

The reliability of the refrigeration cycle apparatus can be improved by using a crystalline resin material that suppresses the occurrence of expansion in a component in contact with a refrigerant.

DESCRIPTION OF EMBODIMENTS

Figure 1:
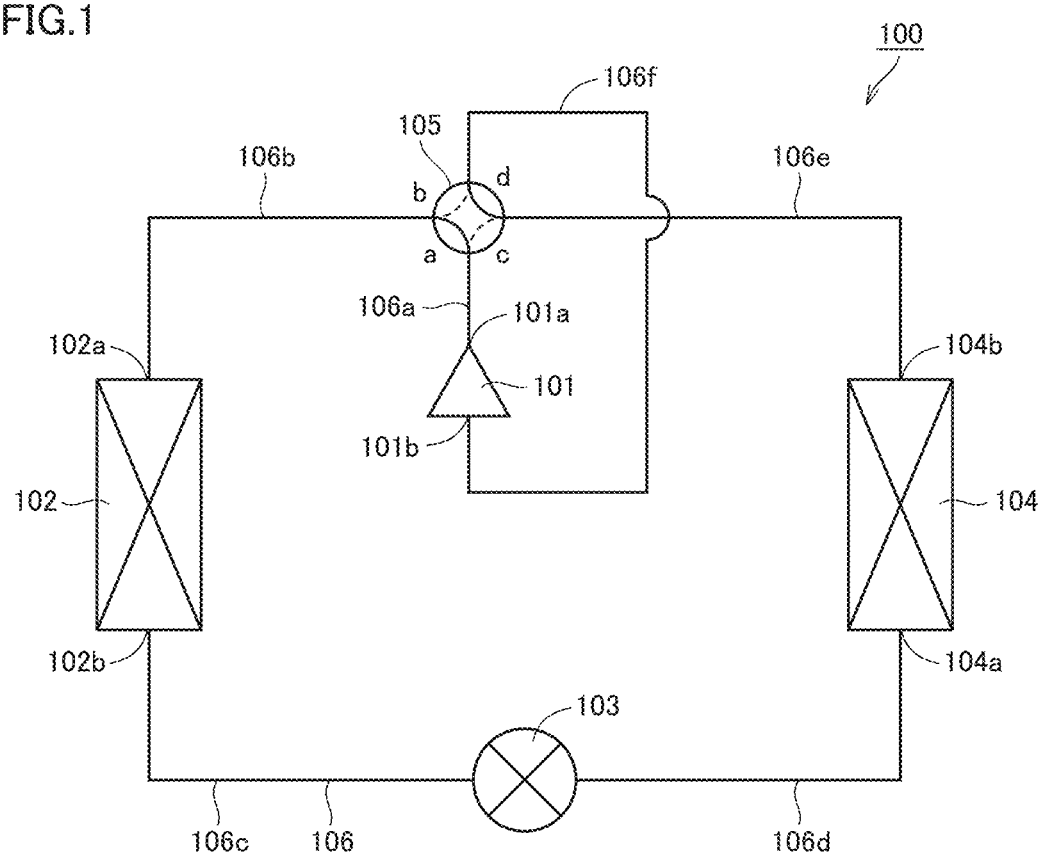
FIG. 1 is a schematic configuration diagram of an air conditioner which serves as an example of a refrigeration cycle apparatus according to an embodiment of the present disclosure.

Hereinafter, embodiments of the present disclosure will be described with reference to the drawings. In the drawings, the dimensions such as the length, width, thickness, and depth may be appropriately modified for clarity and simplification of the drawings, and may not represent the actual dimensions.

First Embodiment

First, an outline of a refrigeration cycle apparatus will be briefly described. FIG. 1 is a schematic configuration diagram of an air conditioner which serves as an example of a refrigeration cycle apparatus according to a first embodiment. The air conditioner 100 is configured to perform an air condition in a room of a building, for example. The air conditioner 100 includes a compressor 101, an outdoor heat exchanger 102, a decompressor 103, an indoor heat exchanger 104, a flow path switching device 105, a refrigerant pipe 106, and the like. The compressor 101, the outdoor heat exchanger 102, the decompressor 103, the indoor heat exchanger 104, and the flow path switching device 105 are connected by the refrigerant pipe 106 in a circular manner. Therefore, a refrigerant circuit is formed in which refrigerant is sequentially circulated through the compressor 101, the outdoor heat exchanger 102, the decompressor 103, the indoor heat exchanger 104, and the flow path switching device 105.

The compressor 101 is provided with a discharge port 101*a* and a suction port 101*b*, and is configured to compress the refrigerant sucked from the suction port 101*b* into a high-temperature and high-pressure gas state and discharge it from the discharge port 101*a*. The decompressor 103 is configured to reduce the pressure of the refrigerant flowing therethrough. An electronic expansion valve, a capillary tube, or the like may be used as the decompressor 103.

Thus, a refrigerant circuit is formed in the refrigeration cycle apparatus, and the refrigerant is circulated in the refrigerant circuit through liquid pipes and gas pipes.

A flow path that connects a first connection port 102*a* and a second connection port 102*b* is formed in the outdoor heat exchanger 102, whereby heat is exchanged between the refrigerant flowing through the flow path and the air outside the building.

A flow path that connects a first connection port 104*a* and a second connection port 104*b* is formed in the indoor heat exchanger 104, whereby heat is exchanged between the refrigerant flowing through the flow path and the air inside the building.

The flow path switching device 105 switches the flow direction of the refrigerant flowing through the refrigerant circuit. Specifically, the flow path switching device 105 is a four-way valve having four ports of a port a, a port b, a port c, and a port d.

The refrigerant pipe 106 is constituted by a first refrigerant pipe 106*a*, a second refrigerant pipe 106*b*, a third refrigerant pipe 106*c*, a fourth refrigerant pipe 106*d*, a fifth refrigerant pipe 106*e*, and a sixth refrigerant pipe 106*f*. The first refrigerant pipe 106*a* connects the discharge port 101*a* of the compressor 101 and the port a of the flow path switching device 105. The second refrigerant pipe 106*b* connects the port b of the flow path switching device 105 and the first connection port 102*a* of the outdoor heat exchanger 102. The third refrigerant pipe 106*c* connects the second connection port 102*b* of the outdoor heat exchanger 102 and the decompressor 103. The fourth refrigerant pipe 106*d* connects the decompressor 103 and the first connection port 104*a* of the indoor heat exchanger 104. The fifth refrigerant pipe 106*e* connects the second connection port 104*b* of the indoor heat exchanger 104 and the port c of the flow path switching device 105. The sixth refrigerant pipe 106*f* connects the port d of the flow path switching device 105 and the suction port 101*b* of the compressor 101.

Next, the flow of the refrigerant flowing through the refrigerant circuit in the air conditioner 100 will be described. The air conditioner 100 includes two refrigerant circuits switched by the flow path switching device 105, i.e., a refrigerant circuit during the cooling operation and a refrigerant circuit during the heating operation.

Figure 2:
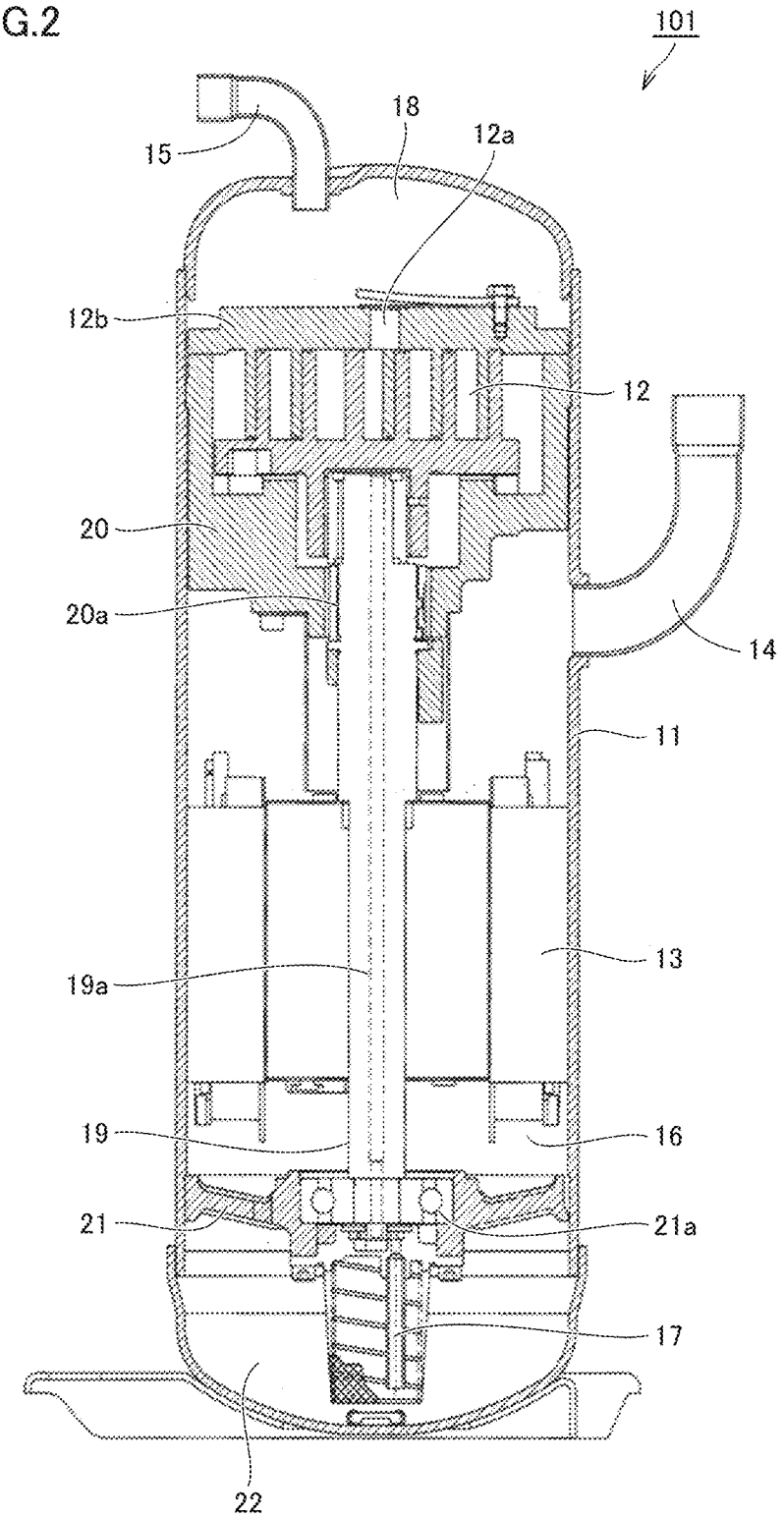
FIG. 2 is a schematic cross-sectional view illustrating an example of a compressor according to an embodiment of the present disclosure.

The flow of the refrigerant flowing through the refrigerant circuit during the cooling operation will be described. FIG. 2 is a schematic cross-sectional view illustrating an example of a compressor according to the present embodiment. In the refrigerant circuit during the cooling operation, as indicated by a solid line in FIG. 2, the flow path switching device 105 is in such a state that the port a and the port b are connected to each other and the port c and the port d are connected to each other. The high-temperature and high-pressure gas refrigerant discharged from the discharge port 101*a* of the compressor 101 flows through the first refrigerant pipe 106*a*, the flow path switching device 105, and the second refrigerant pipe 106*b*, and then flows into the flow path inside the outdoor heat exchanger 102 from the first connection port 102*a*. The refrigerant flowing through the flow path inside the outdoor heat exchanger 102 is cooled by the outdoor air. In other words, in the refrigerant circuit during the cooling operation, the outdoor heat exchanger 102 functions as a condenser.

The refrigerant cooled in the outdoor heat exchanger 102 flows out of the outdoor heat exchanger 102 from the second connection port 102*b* in the form of a low-temperature and high-pressure liquid. The refrigerant flowing out of the outdoor heat exchanger 102 flows into the decompressor 103 via the third refrigerant pipe 106*c*. The low-temperature and high-pressure liquid refrigerant flowing into the decompressor 103 is decompressed into a low-temperature and low-pressure gas-liquid two-phase refrigerant, and flows out of the decompressor 103. The refrigerant flowing out of the decompressor 103 flows from the first connection port 104*a* into the flow path inside the indoor heat exchanger 104 via the fourth refrigerant pipe 106*d*. The refrigerant flowing through the flow path inside the indoor heat exchanger 104 is heated by the indoor air. In other words, the indoor air is cooled by the refrigerant flowing through the flow path inside the indoor heat exchanger 104. In other words, in the refrigerant circuit during the cooling operation, the indoor heat exchanger 104 functions as an evaporator.

The refrigerant heated in the indoor heat exchanger 104 flows out of the indoor heat exchanger 104 from the second connection port 104*b* in the form of a high-temperature and low-pressure gas. The refrigerant flowing out of the indoor heat exchanger 104 is sucked into the compressor 101 from the suction port 101*b* of the compressor 101 via the fifth refrigerant pipe 106*e*, the flow path switching device 105, and the sixth refrigerant pipe 106*f*. The refrigerant sucked into the compressor 101 is discharged from the discharge port 101*a* again in the form of a high-temperature and high-pressure gas. As described above, as the refrigerant flows through the refrigerant circuit, the indoor air is cooled, and thereby the room is conditioned.

The flow of the refrigerant flowing through the refrigerant circuit during the heating operation will be described. In the refrigerant circuit during the heating operation, as indicated by a broken line in FIG. 1, the flow path switching device 105 is such in a state that the port a and the port c are connected to each other and the port b and the port d are connected to each other. The high-temperature and high-pressure gas refrigerant discharged from the discharge port 101*a* of the compressor 101 flows through the first refrigerant pipe 106*a*, the flow path switching device 105, and the fifth refrigerant pipe 106*e*, and then flows into the flow path inside the indoor heat exchanger 104 from the second connection port 104*b*. The refrigerant flowing through the flow path inside the indoor heat exchanger 104 is cooled by the indoor air. In other words, the indoor air is heated by the refrigerant flowing through the flow path inside the indoor heat exchanger 104. In other words, in the refrigerant circuit during the heating operation, the indoor heat exchanger 104 functions as a condenser.

The refrigerant cooled in the indoor heat exchanger 104 flows out of the indoor heat exchanger 104 from the first connection port 104*a* in the form of a low-temperature and high-pressure liquid. The refrigerant flowing out of the indoor heat exchanger 104 flows into the decompressor 103 via the fourth refrigerant pipe 106*d*. The low-temperature and high-pressure liquid refrigerant flowing into the decompressor 103 is decompressed into a low-temperature and low-pressure gas-liquid two-phase refrigerant, and flows out of the decompressor 103. The refrigerant flowing out of the decompressor 103 flows from the second connection port 102*b* into the flow path inside the outdoor heat exchanger 102 via the third refrigerant pipe 106*c*. The refrigerant flowing through the flow path inside the outdoor heat exchanger 102 is heated by the outdoor air. In other words, in the refrigerant circuit during the heating operation, the outdoor heat exchanger 102 functions as an evaporator.

The refrigerant heated in the outdoor heat exchanger 102 flows out of the outdoor heat exchanger 102 from the first connection port 102*a* in the form of a high-temperature and low-pressure gas. The refrigerant flowing out of the outdoor heat exchanger 102 is sucked into the compressor 101 from the suction port 101*b* of the compressor 101 via the second refrigerant pipe 106*b*, the flow path switching device 105, and the sixth refrigerant pipe 106*f*. The refrigerant sucked into the compressor 101 is discharged from the discharge port 101*a* again in the form of a high-temperature and high-pressure gas. As described above, as the refrigerant flows through the refrigerant circuit, the indoor air is heated, and thereby the room is conditioned.

Refrigerant

Next, the refrigerant enclosed in the refrigerant circuit according to the present embodiment will be described. Although the refrigerant used in the present embodiment is not particularly limited, it is preferable that the Global Warming Potential (GWP) of the refrigerant is 750 or less, for example. This is because when the GWP is 750 or less, the refrigerant is excellent in environmental performance and highly compliant with law regulations. When the GWP of the refrigerant is 750 or less, the refrigerant can be used not only in a refrigerator but also in an air conditioner as a refrigeration cycle apparatus. As the GWP, the values (100-year values) listed in the 5th Evaluation Report (AR5) by the Intergovernmental Panel on Climate Change (IPCC) are used. For the GWP of a refrigerant not listed in AR5, a value described in any other known literatures or a value calculated or measured using a known method may be used.

Examples of the refrigerant with a GWP of 750 or less include, for example, R32, R454A, R454B, R454C, R466A, R513A, R290, R1234yf, and the like.

The refrigerant used in the present embodiment is preferably a refrigerant which is classified as nonflammable in ISO817: 2014, for example. This is because the use of a refrigerant which is classified as nonflammable eliminates the need to provide means, equipment or structure to diffuse the refrigerant leaked from the refrigeration cycle apparatus, a sensor to detect a refrigerant leakage, or an alarm device to alarm when the sensor detects a refrigerant leakage. In addition, a refrigerant which is classified as nonflammable can be used in a region where the use of a flammable refrigerant is not permitted by law regulations.

Examples of the refrigerant which is classified as nonflammable in ISO817: 2014 include, for example, R134a, R407H, R410A, R448A, R449A, R463A, R466A, R513A, R744, and the like.

Compressor

In the present embodiment, the refrigeration cycle apparatus includes a compressor. The refrigerant flows through the compressor.

FIG. 2 is a schematic cross-sectional view illustrating an example of a compressor according to the present embodiment, and specifically a cross-sectional view of a scroll compressor cut along a cross section parallel to an axial direction of a main shaft of a motor. However, in the present embodiment, the compressor is not limited to a scroll compressor, and may be a rotary compressor, a screw compressor, or the like.

The compressor 101 includes a shell 11. The shell 11 houses a compression mechanism 12 and an electric motor 13 in a lower space 16 and configured to drive the compression mechanism 12. Further, the shell 11 is connected to a suction pipe 14 for sucking the refrigerant inside the shell and a discharge pipe 15 for discharging the refrigerant outside the shell.

The refrigerant sucked inside from the suction pipe 14 flows into the lower space 16 of the shell 11 where the electric motor 13 and the like are housed. The refrigerant flowing into the lower space 16 flows through a gap or the like around the electric motor 13 to cool the electric motor 13, and then is sucked into the compression mechanism 12, and then the refrigerant flows through the discharge port 12*a* of the compression mechanism 12 and an upper space 18 of the shell 11, and is discharged from the discharge pipe 15 connected to the upper space. In other words, the compression mechanism 12 is configured to compress the refrigerant that flows into the shell 11 from the suction pipe 14 and discharge the refrigerant from the discharge pipe 15.

The compression mechanism 12 is a scroll-type compression mechanism composed of teeth of a fixed scroll and teeth of an oscillating scroll. When the oscillating scroll oscillates, the refrigerant sucked through gaps between the teeth of the surrounding fixed scroll is compressed toward the center and discharged into the upper space 18 from the discharge port 12*a* disposed in the center of a base plate 12*b* of the fixed scroll. The upper space 18 and the lower space 16 are partitioned by the base plate 12*b* of the fixed scroll. The upper space 18 has a smaller volume than the lower space 16, and the pressure of the most part of the shell 11 is equal to the pressure of the sucked refrigerant gas. In other words, the compressor 101 is a low-pressure shell compressor.

The electric motor 13 transmits a compression power to the compression mechanism 12 by means of a drive shaft 19. For example, a crank is disposed in the compressor 101, and the crank is configured to convert the rotation of the drive shaft 19 into an oscillating motion of the oscillating scroll.

The compressor 101 includes a main frame 20 which includes a bearing configured to rotatably hold the drive shaft 19 in the shell 11, and a sub-frame 21 which is disposed below the main frame 20.

The compressor 101 includes a slide member in the compression mechanism 12 and in the bearing of the drive shaft 19. In order to lubricate the slide member, refrigeration oil is stored in an oil reservoir 22 located below the compressor 101. The refrigeration oil stored in the oil reservoir 22 is supplied to the slide member in the bearing of the drive shaft 19 and the slide member inside the compression mechanism 12 through an oil supply hole 19*a* provided inside the drive shaft 19. The low-pressure shell compressor 101 is provided with an oil pump 17 installed below the drive shaft 19 so as to supply lubrication oil to the inside of the compression mechanism 12 through the oil supply hole 19*a*.

The refrigeration oil used in the present embodiment is not particularly limited, and may include polyol ester oil, polyvinyl ether oil, polyalkylene glycol oil, alkylbenzene oil, mineral oil, poly α-olefin, or a mixture thereof.

The refrigeration oil may contain an antioxidant, an acid scavenger, or an extreme pressure agent (an anti-wear agent) as an oil additive.

The antioxidant may include phenols such as 2,6-di-tert-butyl-4-methylphenol, 2,6-di-tert-butyl-4-ethylphenol, and 2,2'-methylenebis(4-methyl-6-tert-butylphenol), or amines such as phenyl-α-naphthylamine and N.N'-di-phenyl-p-phenylenediamine.

The acid scavenger may preferably include epoxy compounds such as phenylglycidyl ether, alkylglycidyl ether, alkylene glycol glycidyl ether, cyclohexene oxide, α-olefin oxide, epoxidized soybean oil, glycidyl ester, glycidyl ether, or α-olefin oxide.

The extreme pressure agent (the anti-wear agent) may include phosphorus extreme pressure agents such as phosphate ester, acidic phosphate ester, phosphite ester, acidic phosphite ester, or amine salts thereof, and may preferably include tricresyl phosphate, trithiophenyl phosphate, tri (nonylphenyl)phosphite, dioleyl hydrogen phosphite, or 2-ethylhexyldiphenyl phosphite.

Since moisture in the refrigeration oil may accelerate the deterioration of the refrigerant, the refrigeration oil, and the materials in the compressor, it is necessary to control the moisture content in the refrigeration oil to 100 ppm by weight or less.

Component

In the present embodiment, the refrigerant circuit includes a component in contact with the refrigerant. The surface of the component in contact with the refrigerant contains a crystalline resin material which will be described later.

The component may be any resin-made component such as an insulator or an insulating film disposed in the electric motor 13, the four-way valve 105, or a check valve disposed in the refrigerant pipe 106.

The resin-made component may be made in such a manner that only the surface thereof in contact with the refrigerant is made of the crystalline resin material of the present embodiment, or the entire component is made of the crystalline resin material of the present embodiment.

Crystalline Resin Material

In the present embodiment, the surface of a component in contact with the refrigerant contains a crystalline resin material. The crystalline resin material may include polyphenylene sulfide (PPS), polyethylene terephthalate (PET), polybutylene terephthalate (PBT), or liquid crystal polymer (LCP). According to the present embodiment, when the temperature of the crystalline resin material is raised at a temperature rise rate of 10° C./min using a differential scanning calorimeter (DSC), a value (DDSC) obtained by differentiating an amount of heat measured by the differential scanning calorimeter with respect to time does not have an exothermic peak of 20 μW/mg/min or more in a temperature range of a glass transition temperature of the crystalline resin material to a melting point thereof. Hereinafter, the reason why such a crystalline resin material is used will be described.

The refrigerant is circulated by the compressor 101. In the refrigerant circuit, the refrigerant is present in the form of a liquid or gas. The refrigerant undergoes a phase transition from a liquid state to a gaseous state or from a gaseous state to a liquid state when the refrigeration cycle equipment is started, stopped, or switched between the operation states.

The component described above is used in locations where the refrigerant may be present in the liquid state or the gaseous state. When the refrigerant is in a liquid state, the refrigerant may soak into a component made of a conventional resin material. When the soaked liquid refrigerant undergoes a phase transition to a gas refrigerant, its volume increases. Accordingly, the resin material also expands, resulting in a deformation of the component, which may reduce the reliability of the refrigeration cycle apparatus.

In view of the above problem, the present inventors have intensively studied resin materials that will not be expanded by the refrigerant, and as a result, they have proposed the crystalline resin material described above.

The crystalline resin material of the present embodiment is a resin material that has a crystalline structure, but may contain an amorphous portion that does not have a crystalline structure. The crystalline state of a crystalline resin material is commonly analyzed by using DSC. DSC is an apparatus capable of measuring an amount of heat when the temperature is raised at a predefined rate. When the state of the test sample changes as the temperature rises, the sample may absorb from or emit heat to the ambient environment. Therefore, a change in the state of the sample may be confirmed using DSC.

When a crystalline resin material contain an amorphous portion, the crystallization of the amorphous portion occurs in a temperature range of a glass transition temperature of the crystalline resin material to a melting point thereof during the process of raising the temperature (at a temperature rise rate of 10° C./min) by using DSC, and thereby heat is generated. Therefore, if the crystalline resin material exhibits an exothermic peak during the temperature raising process by DSC, it can be confirmed that the crystalline resin material does not have a sufficient crystalline portion.

On the other hand, during the temperature raising process by DSC, although it can be confirmed that an amorphous portion is included due to the presence of an exothermic peak, the absolute value of the exothermic peak varies depending on the type of the crystalline resin material or the inclusion of an ingredient other than the crystalline resin material. For example, when a filler such as glass fiber is contained in addition to the crystalline resin material, the exothermic peak becomes small, and it may be difficult to confirm whether or not the crystalline resin material contains an amorphous portion.

Therefore, the present inventors have managed to eliminate the above-described factors by using the DDSC, i.e., the value obtained by differentiating the amount of heat measured by the DSC with respect to time. A high DDSC means that there is a rapid change from the baseline, which makes it possible to confirm the presence or absence of an exothermic peak.

However, in consideration of the measurement noise, the crystalline resin material was used in the present embodiment when the DDSC does not have an exothermic peak of 20 μW/mg/min or more in a temperature range of the glass transition temperature of the crystalline resin material to the melting point thereof. In the present embodiment, if the DDSC exhibits an exothermic peak as mentioned above, it means that crystallization occurs in the amorphous portion, and thus it can be numerically confirmed that the crystalline resin material does not have a sufficient crystalline portion.

EXAMPLES

Hereinafter, the present disclosure will be described in detail with reference to the examples, but the present disclosure is not limited thereto.

Evaluation Test 1

Figure 3:
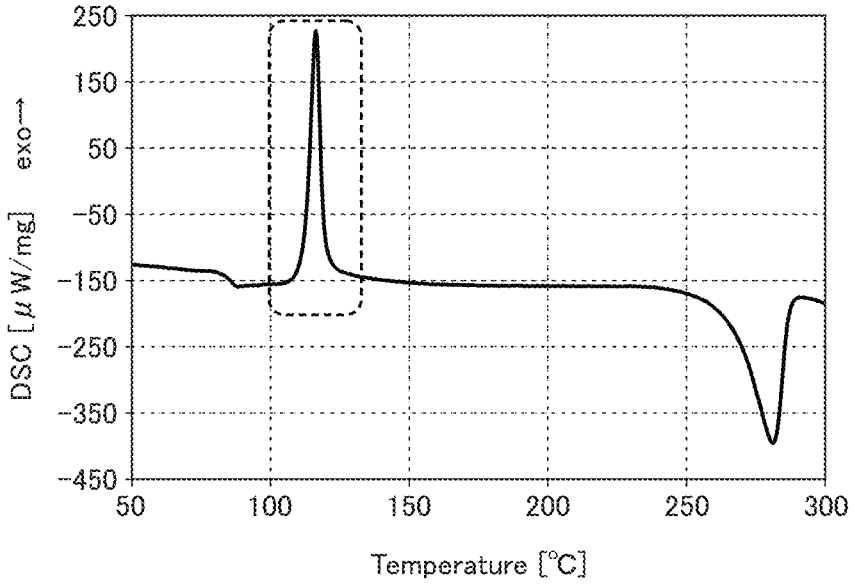
FIG. 3 is a graph of differential scanning calorimetry values of sample No. 1.
Figure 4:
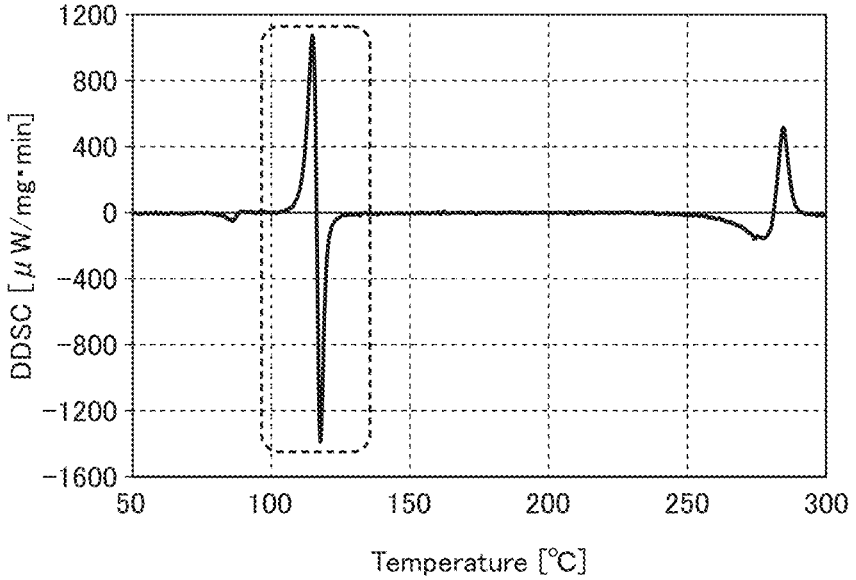
FIG. 4 is a graph of time differential values of differential scanning calorimetry values of sample No. 1.
Figure 5:
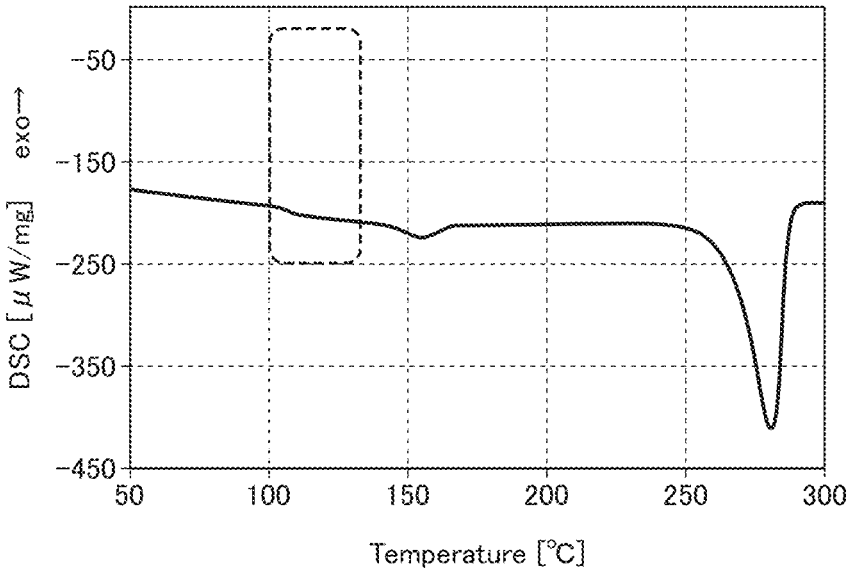
FIG. 5 is a graph of differential scanning calorimetry values of sample No. 2.
Figure 6:
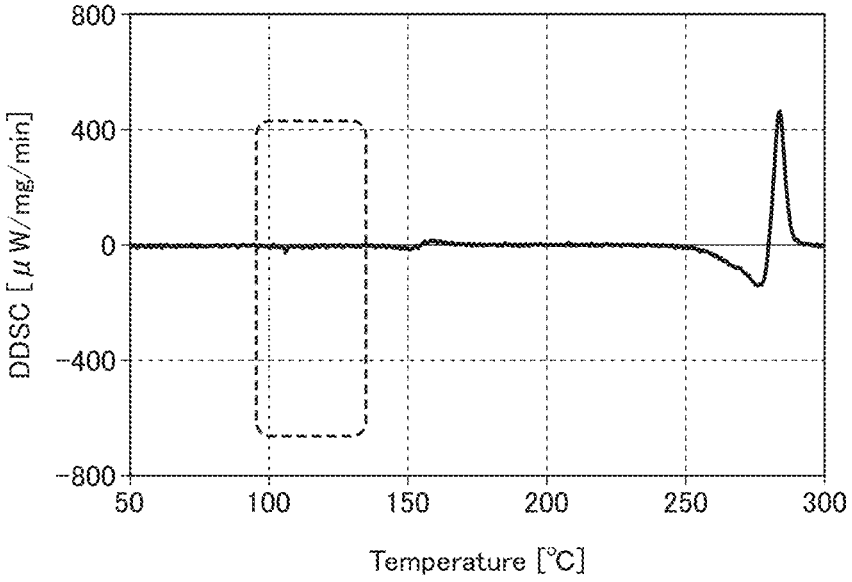
FIG. 6 is a graph of time differential values of differential scanning calorimetry values of sample No. 2.

PPS (sample No. 1 and sample No. 2) was prepared as test samples of the crystalline resin material. These test samples were subjected to differential scanning calorimetry using a differential scanning calorimeter (DSC6220 manufactured by Hitachi High-Tech Science Corporation) under the following conditions. The DDSC was obtained by differentiating the measured amount of heat with respect to time. The results are shown in FIGS. 3 to 6. FIGS. 3 and 5 are graphs of differential scanning calorimetry values of sample No. 1 and sample No. 2, and FIGS. 4 and 6 are graphs of the DDSC of sample No. 1 and sample No. 2. The glass transition temperature of PPS is 85° C., and the melting point thereof is 280° C.

Measurement Conditions

Amount of sample: 2 to 10 mg

Atmospheric gas: nitrogen

Temperature range: 50 to 300° C.

Temperature rise rate: 10° C./min

The peak circled by a dotted line in FIG. 3 represents an exothermic peak appeared due to the crystallization of the test sample, and the upward convex peak circled by a dotted line in FIG. 4 corresponds to the exothermic peak. From FIG. 4, it was confirmed that the DDSC of sample No. 1 had an exothermic peak of about 1050 μW/mg/min in a temperature range of the glass transition temperature to the melting point.

On the other hand, there is no exothermic peak in the area circled by the dotted line in FIG. 5, and there is no upward convex peak in the area circled by the dotted line in FIG. 6. In other words, from FIG. 6, it was confirmed that the DDSC of sample No. 2 does not have an exothermic peak of 20 μW/mg/min or more in the temperature range of the glass transition temperature to the melting point.

As described above, since sample No. 1 has an exothermic peak of 20 μW/mg/min or more in the temperature range of the glass transition temperature to the melting point thereof, and sample No. 2 does not have an exothermic peak of 20 μW/mg/min or more in the temperature range of the glass transition temperature to the melting point thereof, it was confirmed that sample No. 1 is a PPS having no sufficient crystalline portion, and sample No. 2 was a PPS having a sufficient crystalline portion.

Evaluation Test 2

Test pieces (thickness: 3 mm) were prepared from sample No. 1 and sample No. 2, respectively. Each test piece was soaked in a liquid refrigerant and then subjected to a phase transition in which the liquid refrigerant is converted to a gas refrigerant by heating, and this process was repeated by the number of times as shown in Table 1 to measure a change in thickness (expansion coefficient) of each test piece. The results are shown in Table 1.

TABLE 1

| Sample No. | Number of Repeated Times | Expansion Coefficient (%) |
|---|---|---|
| 1 | 1 | 4 |
| | 2 | 7 |
| | 3 | 8 |
| | 4 | 9 |
| | 5 | 10 |
| 2 | 1 | 0 |
| | 2 | 0 |
| | 3 | 0 |
| | 4 | 0 |
| | 5 | 0 |

As shown in Table 1, the test piece of sample No. 1 expanded by performing the above-mentioned process for 1 time, and the expansion coefficient increased as the number of repeated times increased. On the other hand, the test piece of sample No. 2 did not expand even if the above-mentioned process was performed for 1 time, and the expansion coefficient did not change even if the number of repeated times increased.

Evaluation Test 3

In addition to the test pieces of sample No. 1 and sample No. 2 used in the evaluation test 2, a test piece (sample No. 3) with the same thickness was prepared from PPS. The same test as the evaluation test 2 was repeated for 5 times on the test piece of sample No. 3 to measure the expansion coefficient thereof. The result is shown in Table 2. The same test was repeated for 5 times on the test piece of sample No. 1 and the test piece of sample No. 2 to measure the expansion coefficient thereof. The DDSC of sample No. 3 made of PPS was determined under the same conditions as in the evaluation test 1, and it was confirmed that the DDSC has an exothermic peak of about 640 μW/mg/min in the temperature range of the glass transition temperature to the melting point thereof.

TABLE 2

| Sample No. | Expansion Coefficient (%) |
|---|---|
| 1 | 10 |
| 2 | 0 |
| 3 | 8 |

Table 2 shows that the expansion coefficients of the test pieces were in the order of sample No. 2<sample No. 3<sample No. 1. This agrees with the magnitude of the exothermic peak in the temperature range of the glass transition temperature to the melting point for the DDSC of the PPS constituting each test piece. In other words, it was confirmed that there is a correlation between the magnitude of the exothermic peak and the expansion coefficient.

From the results of the evaluation tests 1 to 3, it was confirmed that when the temperature was raised at a temperature rise rate of 10° C./min using DSC, if the DDSC had no exothermic peak of 20 μW/mg/min or more in the temperature range of the glass transition temperature to the melting point of PPS, the test piece did not expand. Therefore, it is considered that the reliability of the entire refrigeration cycle apparatus can be ensured by using such a crystalline resin material for a component that comes into contact with the refrigerant in the refrigeration cycle apparatus.

It should be understood that the embodiments and examples disclosed herein are illustrative and non-restrictive in all respects. The scope of the present invention is defined by the terms of the claims rather than the description in the above, and is intended to include all modifications within the scope and meaning equivalent to the claims.

REFERENCE SIGNS LIST

100 air conditioner; 101 compressor; 101*a* discharge port; 101*b* suction port; 102 outdoor heat exchanger; 102*a* first connection port; 102*b* second connection port; 103 decompressor; 104 indoor heat exchanger; 104*a* first connection port; 104*b* second connection port; 105 flow path switching device; 106 refrigerant pipe; 106*a* first refrigerant pipe; 106*b* second refrigerant pipe;

106*c* third refrigerant pipe; 106*d* fourth refrigerant pipe; 106*e* fifth refrigerant pipe; 106*f* sixth refrigerant pipe; 11 shell; 12 compression mechanism; 12*a* discharge port; 12*b* base plate; 13 electric motor; 14 suction pipe; 15 discharge pipe; 16 lower space; 17 oil pump; 18 upper space; 19 drive shaft; 19*a* oil supply hole; 20 main frame; 20*a* bearing; 21 sub-frame; 21*a* sub-bearing; 22 oil reservoir.

The invention claimed is:

1. A refrigeration cycle apparatus comprising:

a refrigerant circuit that includes a compressor, wherein the refrigerant circuit is enclosed with refrigerant, the refrigerant circuit includes a component in contact with the refrigerant, a surface of the component in contact with the refrigerant contains a crystalline resin material, and a temperature of the crystalline resin material is capable of being raised at a temperature rise rate of 10° C./min using a differential scanning calorimeter such that a value obtained by differentiating an amount of heat measured by the differential scanning calorimeter with respect to time does not have an exothermic peak of 20 μW/mg/min or more in a temperature range of a glass transition temperature of the crystalline resin material to a melting point of the crystalline resin material.

2. The refrigeration cycle apparatus according to claim 1, wherein the component is at least one selected from the group consisting of an insulator, an insulating film, a four-way valve, and a check valve.

3. The refrigeration cycle apparatus according to claim 1, wherein the crystalline resin material is at least one selected from the group consisting of polyphenylene sulfide, polyethylene terephthalate, polybutylene terephthalate, and a liquid crystal polymer.

4. The refrigeration cycle apparatus according to claim 2, wherein the crystalline resin material is at least one selected from the group consisting of polyphenylene sulfide, polyethylene terephthalate, polybutylene terephthalate, and a liquid crystal polymer.

5. The refrigeration cycle apparatus according to claim 1, wherein the component is an insulator or an insulating film disposed in an electric motor.

6. The refrigeration cycle apparatus according to claim 1, wherein the component comes in contact with the refrigerant in at least a liquid state.

* * * * *